US010352616B2

(12) United States Patent
Currence

(10) Patent No.: US 10,352,616 B2
(45) Date of Patent: Jul. 16, 2019

(54) ENHANCED LOW TEMPERATURE SEPARATION PROCESS

(71) Applicant: Black & Veatch Holding Company, Overland Park, KS (US)

(72) Inventor: Kevin L. Currence, Olathe, KS (US)

(73) Assignee: Black & Veatch Holding Company, Overland Park, KS (US)

( * ) Notice: Subject to any disclaimer, the term of this patent is extended or adjusted under 35 U.S.C. 154(b) by 355 days.

(21) Appl. No.: 15/337,684

(22) Filed: Oct. 28, 2016

(65) Prior Publication Data

US 2017/0122658 A1 May 4, 2017

Related U.S. Application Data

(60) Provisional application No. 62/248,148, filed on Oct. 29, 2015.

(51) Int. Cl.
*F25J 1/00* (2006.01)
*F25J 3/02* (2006.01)

(52) U.S. Cl.
CPC ..... *F25J 1/0022* (2013.01); *F25J 3/0238* (2013.01); *F25J 2205/02* (2013.01); *F25J 2205/50* (2013.01); *F25J 2210/06* (2013.01); *F25J 2210/60* (2013.01); *F25J 2215/04* (2013.01); *F25J 2215/64* (2013.01); *F25J 2215/66* (2013.01); *F25J 2220/64* (2013.01); *F25J 2235/60* (2013.01); *F25J 2240/40* (2013.01);

(Continued)

(58) Field of Classification Search
CPC ..... F25J 3/0238; F25J 2200/78; F25J 2205/50
See application file for complete search history.

(56) References Cited

U.S. PATENT DOCUMENTS 2,547,970 A 4/1951 Phillips et al.
4,171,964 A 10/1979 Campbell et al.
(Continued)

FOREIGN PATENT DOCUMENTS

CN 101445419 10/2012
DE 102009038456 3/2011
(Continued)

OTHER PUBLICATIONS

Mowrey, E. Ross, "Efficient, High Recovery of Liquids From Natural Gas Utilizing a High Pressure Absorber" Lummus Process Technology—Randall Gas Technologies, 2003.
(Continued)

*Primary Examiner* — Tareq Alosh
(74) *Attorney, Agent, or Firm* — Hovey Williams LLP

(57) ABSTRACT

Enhanced low temperature separation (LTS) processes are provided for separating light hydrocarbon components from heavy hydrocarbon components. The enhanced LTS process utilizes an absorber and a de-ethanizer tower to achieve sufficiently pure natural gas liquid (NGL) products and residue gas products. A portion of the de-ethanizer tower overhead is condensed and recycled as reflux for the absorber. The enhanced LTS process requires less refrigeration of the feed gas stream yet still achieves increased recovery of the valuable heavier hydrocarbons from hydrocarbon gas streams. The enhanced LTS process also reduces compression requirements compared to conventional LTS processes.

19 Claims, 3 Drawing Sheets

(52) U.S. Cl.
CPC ..... *F25J 2270/02* (2013.01); *F25J 2270/08* (2013.01); *F25J 2270/90* (2013.01)

(56) References Cited

U.S. PATENT DOCUMENTS

| | | | | |
|---|---|---|---|---|
| 4,251,249 | A | 2/1981 | Gulsby | |
| 4,509,967 | A | 4/1985 | Sweet | |
| 5,035,732 | A | 7/1991 | McCue, Jr. | |
| 5,685,170 | A * | 11/1997 | Sorensen | B01D 53/1418 62/625 |
| 6,601,406 | B1 | 8/2003 | Deng et al. | |
| 2004/0025535 | A1 | 2/2004 | Mak | |
| 2005/0204774 | A1 | 9/2005 | Foglietta et al. | |
| 2007/0219401 | A1 | 9/2007 | Duc | |
| 2007/0284286 | A1 | 12/2007 | Duhon et al. | |
| 2009/0173103 | A1 | 7/2009 | Mak | |
| 2012/0000245 | A1 | 1/2012 | Currence et al. | |
| 2012/0267137 | A1 * | 10/2012 | Raasch | F02M 1/02 173/184 |
| 2014/0075987 | A1 * | 3/2014 | Mak | F25J 3/0228 62/630 |
| 2014/0187840 | A1 | 7/2014 | Fan et al. | |
| 2014/0260420 | A1 * | 9/2014 | Mak | F25J 3/0209 62/620 |
| 2015/0025292 | A1 | 1/2015 | Pham Duc et al. | |
| 2015/0153101 | A1 * | 6/2015 | Gahier | C10L 3/10 62/611 |

FOREIGN PATENT DOCUMENTS

| | | |
|---|---|---|
| RU | 2341738 | 12/2008 |
| RU | 2493898 | 9/2013 |

OTHER PUBLICATIONS

Search Report and Written Opinion dated Feb. 3, 2017, in PCT/US2016/059259 filed Oct. 28, 2016.

* cited by examiner

ENHANCED LOW TEMPERATURE SEPARATION PROCESS

RELATED APPLICATION

This application claims the benefit of U.S. Provisional Patent Application No. 62/248,148, filed Oct. 29, 2015, which is incorporated by reference herein in its entirety.

BACKGROUND OF THE INVENTION

Field of the Invention

The present invention is directed to efficient and low cost recovery of natural gas liquids (NGL) from hydrocarbon gas streams.

Description of the Prior Art

Cryogenic processes are commonly used to recover heavy hydrocarbons from feed gases. By cooling a natural gas, it is possible to condense a portion of the heavy hydrocarbons, which can then be separated. The amount of NGL that is formed is a function of the gas composition, pressure, and temperature to which the gas is cooled. Greater quantities of NGL can be recovered by cooling to colder temperatures, but greater initial investment and ongoing operating expense is required to provide the required refrigeration and pre-treatment.

Refrigeration for the cooling can be supplied by expansion of the gas to lower pressure by the Joule-Thomson effect. Often, the processed gas must then be re-compressed to be delivered into the sales gas pipeline system. This re-compression can represent a significant capital and operating expense.

Depending on natural gas and NGL product pricing, it may not be economical to use highly cryogenic technologies to extract the hydrocarbon liquids. However, in many cases some NGL extraction is required so that the natural gas will meet pipeline specifications such as maximum heating value limitations. In this scenario, a less capital intensive technology is needed.

Simple low temperature separation (LTS) processes have been used for many years in applications where modest NGL recovery is required (see FIG. 1). In such processes, mechanical refrigeration systems are commonly used to provide the required cooling. A significant advantage of using mechanical refrigeration instead of expansion to provide cooling is that the majority of the product gas is typically returned at only slightly lower pressure than the arriving feed gas. This reduces or eliminates re-compression of the gas that is usually required for an expansion-based technology. Further, the more moderate operating temperatures may eliminate the need for certain pre-treatment processes (e.g., carbon dioxide removal), allow for the use of less expensive pre-treatment systems (e.g., glycol dehydration vs. molecular sieve dehydration), and require less usage of alloy metallurgy in piping and equipment, which may further reduce the required investment.

One drawback of traditional LTS processes is a lack of selectivity in the NGL components recovered. Propane, butanes, pentanes, and heavier hydrocarbons each have different product pricing with the heavier components typically having a higher value than the lighter components in the NGL. Therefore, it is economically desirable to recover the heaviest components in the NGL until the sales gas pipeline specifications are met. However, conventional LTS processes do not have means to control the recovery of specific components, and product recovery is largely a function of gas composition at a particular temperature and pressure.

Another drawback of traditional LTS processes is re-compression of the vapor generated during stabilization of the NGL product. The high pressure NGL stream typically contains a significant quantity of lighter components (such as methane) that are also condensed during the chilling process. Heat is supplied in a fractionation tower to remove these light components from the product liquid to meet NGL specifications. These light components are commonly used to satisfy fuel requirements for the facility, but excess gas must be re-compressed and blended into the feed or sales gas stream.

What is needed is a means to improve recovery of the more valuable heavy components from the feed gas and to reduce the quantity of light components that must be re-compressed.

SUMMARY OF THE INVENTION

In one embodiment of the present invention, there is provided an enhanced low temperature process for separating light hydrocarbon components from heavy hydrocarbon components in a feed stream. The process comprises cooling the feed stream by directing the feed stream through at least one heat exchanger so as to condense at least a portion of the feed stream and directing the partially condensed feed stream into an absorber. An absorber overhead vapor stream and an absorber liquid bottoms stream are produced by separation in the absorber. The process further comprises flashing the absorber liquid bottoms stream into a de-ethanizer tower, thereby producing a de-ethanizer overhead vapor stream and a liquid product stream enriched in $C_3$+ hydrocarbon compounds. At least a portion of the de-ethanizer overhead vapor stream is condensed to form a liquid reflux stream, and a first portion of the liquid reflux stream is used as reflux in the de-ethanizer tower. The absorber overhead vapor stream is combined with a second portion of the liquid reflux stream to produce a two-phase absorber recycle stream. Finally, at least a portion of said absorber recycle stream is directed to the absorber as liquid reflux.

In another embodiment, there is provided an enhanced low temperature process for separating light hydrocarbon components from heavy hydrocarbon components in a feed stream. The process comprises splitting the feed stream into a first portion and a second portion, cooling the first portion in a first heat exchanger, and cooling the second portion in a second heat exchanger. The first portion and the second portion are combined to produce a combined cooled feed stream, and the combined cooled feed stream is separated in an absorber, thereby producing an absorber overhead vapor stream and an absorber liquid bottoms stream. The absorber comprises a reboiler, and the second portion of the feed stream provides at least a portion of the heating duty for the reboiler. The process further comprises passing the absorber liquid bottoms stream through the second heat exchanger to provide cooling to the second portion of the feed stream, passing the absorber liquid bottoms stream through an expansion device, and flashing the absorber liquid bottoms stream into a de-ethanizer tower, thereby producing a de-ethanizer overhead vapor stream and a liquid product stream enriched in $C_3$+ hydrocarbon compounds. A portion of the de-ethanizer overhead vapor stream is condensed to form a liquid reflux stream, and the uncondensed portion of the de-ethanizer overhead vapor stream is compressed to form a residue vapor stream. A first portion of the liquid reflux stream is used as reflux in the de-ethanizer tower, and the absorber overhead vapor stream is combined with a second portion of the liquid reflux stream to produce a two-phase absorber recycle stream. The two-phase absorber recycle stream is cooled in a chiller, thereby producing a cooled liquid and a cooled vapor, and the cooled liquid is directed to the absorber as liquid reflux. The cooled vapor is passed through the first heat exchanger to provide cooling to the first portion of the feed stream, and the cooled vapor is combined with the residue vapor stream to produce a combined residue gas stream.

In yet another embodiment, there is provided a low-temperature separation plant for separating $C_3$+ hydrocarbon compounds from a hydrocarbon-containing feed gas stream. The plant comprises a first conduit configured to direct a first portion of the feed gas stream through a first heat exchanger and a second conduit configured to direct a second portion of the feed gas stream through a second heat exchanger. The first portion and second portion are combined as a cooled feed stream in a third conduit after being passed through the first heat exchanger and the second heat exchanger, respectively. The plant further comprises an absorber comprising a reboiler and configured to separate the combined cooled feed stream into an absorber overhead vapor stream and an absorber liquid bottoms stream, wherein the second conduit is configured to direct the second portion of the feed gas stream to the reboiler to provide at least a portion of the heating duty for the reboiler. The absorber liquid bottoms stream is directed through the second heat exchanger to provide cooling to the second portion of the feed gas stream. The plant also comprises an expansion device operable to flash the absorber liquid bottoms stream into a de-ethanizer tower, and the de-ethanizer tower is configured to produce a de-ethanizer overhead vapor stream and a liquid product stream enriched in $C_3$+ hydrocarbon compounds. A condenser is operable to condense a portion of the de-ethanizer overhead vapor stream to form a liquid reflux stream, and a compressor is operable to compress an uncondensed portion of the de-ethanizer overhead vapor stream, thereby forming a residue vapor stream. A de-ethanizer reflux conduit is configured to direct a first portion of the liquid reflux stream to the de-ethanizer tower, while a recycle conduit is configured to combine a second portion of the liquid reflux stream with the absorber overhead vapor stream to produce a two-phase absorber recycle stream. Further, the plant comprises a chiller operable to cool the two-phase absorber recycle stream. A reflux accumulator is used to separate the cooled two-phase absorber recycle stream into a liquid recycle stream and a cooled vapor stream. The reflux accumulator is further configured to direct the cooled liquid recycle stream to the absorber as liquid reflux and to direct the cooled vapor stream through the first heat exchanger to provide cooling to the first portion of the feed gas stream. The residue vapor stream and said cooled vapor are combined in a residue gas stream.

DETAILED DESCRIPTION OF THE PREFERRED EMBODIMENT

Figure 1:
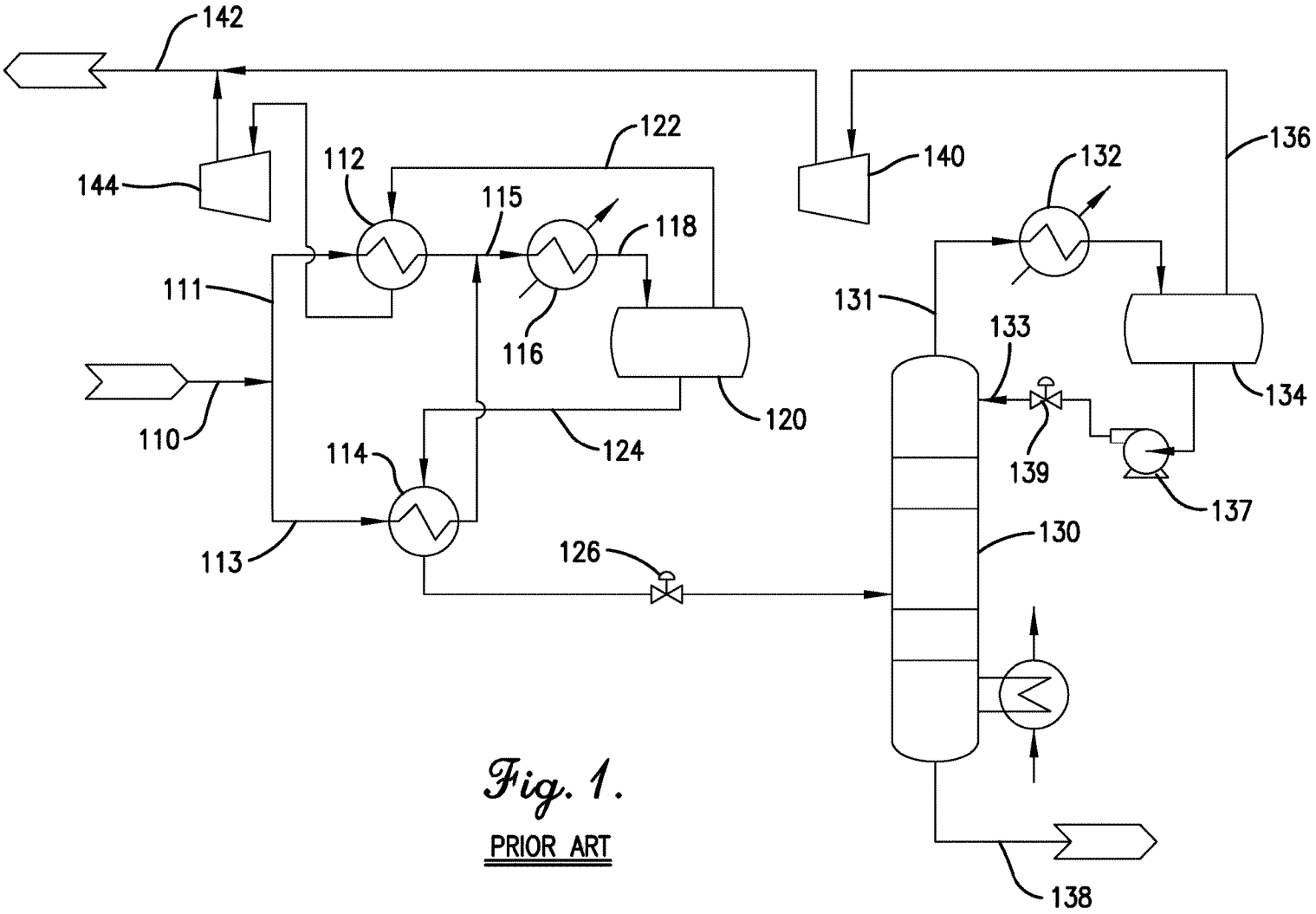
Fig. 1. PRIOR ART
FIG. 1 is a process flow diagram showing a conventional low temperature separation process.

A conventional LTS process is shown in FIG. 1. Feed gas is fed into the system via feed stream 110. The feed gas generally comprises a mixture of hydrocarbons comprising predominantly lighter weight hydrocarbons such as methane and ethane, although a certain quantity of heavier hydrocarbons will also be present in the mixture. For example, the feed gas can be any suitable hydrocarbon-containing predominantly vapor stream, such as a natural gas stream, a synthesis gas stream, a cracked gas stream, or combinations thereof. Feed gas stream 110 can originate from a variety of gas sources (not shown), including, but not limited to, a petroleum production well; a refinery processing unit, such as a fluidized catalytic cracker (FCC) or petroleum coker; or a heavy oil processing unit, such as an oil sands upgrader. In embodiments using a natural gas feed steam, the feed stream may comprise raw natural gas (e.g., associated or non-associated natural gas) or pre-treated natural gas (e.g., dehydrated natural gas). In certain embodiments, therefore, the feed stream is a dehydrated natural gas stream. The feed stream will typically be a single-phase gas mixture, although some amount of condensed heavier hydrocarbons may also be present. The feed stream is typically compressed prior to being fed into the system. For example, the feed stream is typically compressed to about 300 to about 1,000 psia prior to pre-treatment or prior to entry into the LTS system.

The hydrocarbon-containing feed stream 110 generally includes methane, ethane, and $C_3$ and heavier components ($C_3$+). As used herein, the general term "$C_x$" refers to a hydrocarbon component comprising x carbon atoms per molecule and, unless otherwise noted, is intended to include all straight-chain and olefinic isomers thereof. As used herein, the term "$C_x$ and heavier" refers to hydrocarbons having x or more carbon atoms per molecule (including isomers and olefins), while the term "$C_x$ and lighter" refers to hydrocarbons having x or less carbon atoms per molecule (including isomers and olefins). According to one embodiment, feed gas stream 110 can comprise at least 5, at least 10, at least 15, at least 20, or at least 30 mole percent (mol %) $C_3$ and heavier components, although in some embodiments the feed gas may comprise less than about 5 mol % $C_3$ and heavier components. Lighter components such as methane, ethane, hydrogen, and trace amounts of gases like nitrogen and carbon dioxide, generally make up the balance of the composition of the feed gas stream. Feed gas stream 110 typically comprises at least about 50, at least about 60, at least about 70, at least about 80, at least about 90, at least about 95, or at least about 98 mol % of ethane and lighter components, based on the total stream.

Feed stream 110 is split into a first conduit 111 and a second conduit 113, with one portion of feed stream 110 being directed via first conduit 111 through heat exchanger 112 and a second portion of feed stream 110 being directed via second conduit 113 through heat exchanger 114. Both portions in conduits 111 and 113 are cooled in heat exchangers 112 and 114, respectively. The cooling in heat exchangers 112, 114 may be supplied by other process streams, for example, by a cold gas stream or cold liquid stream resulting from downstream processes (described below). After cooling in heat exchangers 112, 114, the split portions are recombined as a cooled feed stream in a third conduit 115 and directed through chiller 116 for further cooling. Chiller 116 may use any suitable refrigerant to accomplish said cooling. For example, in certain embodiments, chiller 116 uses propane or propylene as the refrigerant. Chilled stream 118 exits chiller 116 and generally comprises a two-phase mixture of condensed heavier hydrocarbons and vaporized lighter hydrocarbons.

Chilled stream 118 comprising the two-phase mixture is fed into cold separator 120, which acts to separate the condensed liquid portion of the mixture from the vapor portion. The vapor portion exits cold separator 120 as vapor steam 122. Vapor stream 122 comprises primarily methane, ethane, and lighter hydrocarbons, although some amount of propane and heavier hydrocarbons are also present in vapor steam 122. Vapor stream 122 leaving cold separator 120 is significantly colder than feed stream 110, so vapor stream 122 may be used to provide cooling in heat exchanger 112. Upon exiting heat exchanger 112, vapor stream 122 may be compressed as required in compressor 144 and exits the system as residue gas.

The condensed liquid portion exits cold separator 120 as liquid bottoms stream 124. While liquid bottoms stream 124 will generally comprise mostly methane and ethane (due to large amount of methane and ethane in natural gas feed sources), there will be a larger mole fraction of propane and heavier hydrocarbons in liquid bottoms stream 124 than in vapor stream 122. Liquid bottoms stream 124 is passed through heat exchanger 114 to cool the portion of feed gas stream 110 being conducted through conduit 113 and then directed through expansion device 126. It will be appreciated that expansion device 126 may be located downstream of heat exchanger 114 (as shown in FIG. 1) or upstream of heat exchanger 114, depending on the particular process conditions and design parameters for heat exchanger 114.

Liquid bottoms stream 124 flashes into de-ethanizer 130 to separate the ethane and lighter hydrocarbons as de-ethanizer overhead 131 from the NGL liquid product 138 enriched with propane and heavier ($C_3$+) hydrocarbons. De-ethanizer overhead 131 comprises primarily methane and ethane, although some amount of propane and heavier hydrocarbons are also present. Condenser 132 is configured to condense at least a portion of de-ethanizer overhead 131 (predominantly the propane and heavier hydrocarbons), and thus the stream leaving condenser 132 is generally a two-phase vapor-liquid mixture. The at least partially condensed overhead stream is then fed into reflux accumulator 134, which directs liquid portion of the overhead stream back to de-ethanizer 130 as reflux through pump 137 and valve 139 de-ethanizer reflux conduit 133. The vapor portion leaves accumulator 134 as vapor stream 136 comprising predominantly methane and ethane, which will be combined with vapor stream 122 to form residue gas stream 142. However, vapor stream 136 exits accumulator 134 at a relatively low temperature and pressure (as compared to vapor stream 122 and standard natural gas transport conditions), and thus vapor stream 136 must be re-compressed. Therefore, vapor stream 136 is directed through compressor 140 to increase pressure prior to being combined with vapor stream 122. Compression of vapor stream 136 by compressor 140 accounts for significant energy consumption (operating cost) associated with the conventional LTS process. In certain embodiments, stream 136 may be warmed prior to being compressed, particularly when the volume of vapor stream 136 is particularly large.

A number of cryogenic technologies aimed at the recovery of propane and heavier components from a feed gas are known in the art. These technologies use various two-tower configurations to supply reflux liquid from a downstream de-ethanizer tower to an upstream absorber tower to achieve high propane recovery levels. As referenced herein, cryogenic hydrocarbon recovery technologies (particularly technologies for the recovery of propane and heavier components from a feed gas) are recognized in the art as technologies that utilize operating temperatures of about −100° F. or lower in one or more of the processes. Cryogenic operating temperatures are typically achieved using expansion cooling, mechanical refrigeration, or a combination of both. One such cryogenic process is shown in U.S. Patent Application Publication No. 2012/0000245 ("the '245 publication").

Figure 2:
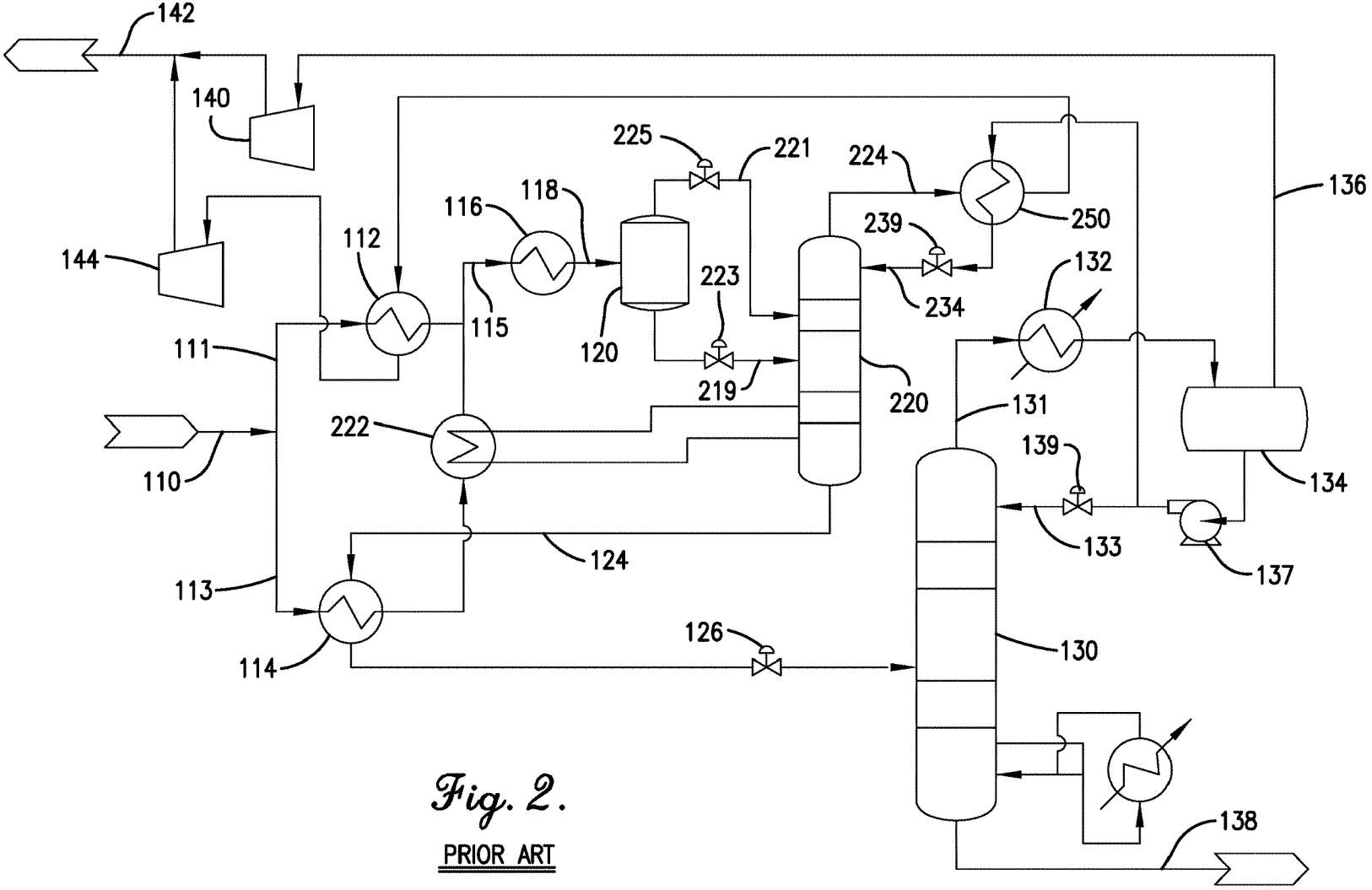
Fig. 2. PRIOR ART
FIG. 2 is a process flow diagram showing a prior art cryogenic propane recovery process.

FIG. 2 demonstrates a cryogenic process according to the '245 publication wherein feed gas is fed into the system via feed stream 110, with one portion of the stream being directed via first conduit 111 through heat exchanger 112 and the other portion of the stream being directed via second conduit 113 through heat exchanger 114. The split portions are then recombined into a third conduit 115 as a cooled feed stream and directed through chiller 116 for further cooling. Adequate cooling must be provided at this point to condense a sufficient quantity of the NGL to allow the residue gas to meet the required heating value specification. As with the conventional LTS process, chiller 116 may use any suitable refrigerant to accomplish said cooling. For example, in certain embodiments, chiller 116 uses propane or propylene as the refrigerant. Chilled stream 118 exits chiller 116 and generally comprises a two-phase mixture of condensed heavier hydrocarbons and vaporized lighter hydrocarbons. Chilled stream 118 is fed to cold separator 120 similar to the conventional LTS process described above. However, in the cryogenic process, the chilled stream 118 is fed via conduits 219 and 221 through expansion valves 223 and 225, respectively, and into absorber 220 to achieve the initial separation of the lighter components (such as methane) from the heavier hydrocarbons (such as propane, butane, etc.). Additionally, the portion of feed stream 110 being conducted via conduit 113 can be used to provide some or all of the thermal energy necessary for reboiler 222 of absorber 220. Heat exchange occurring in reboiler 222 provides further cooling to the portion of feed stream in conduit 113, as well as heating to the bottoms portion of absorber 220.

A condensed liquid exits absorber 220 as liquid bottoms stream 124. Liquid bottoms stream 124 is passed through heat exchanger 114 and used to cool a portion of feed stream 110 being conducted via conduit 113. After exiting heat exchanger 114, liquid bottoms stream 124 is flashed through expansion device 126 and fed into de-ethanizer 130.

De-ethanizer 130 operates similarly in the cryogenic prior art process as in the conventional LTS process insofar as ethane is to be rejected from the liquid product stream. However, a portion of the condensed liquid exiting reflux accumulator 134 is subcooled and recycled back and fed directly to absorber 220. De-ethanizer overhead 131 is at least partially condensed in condenser 132, and the at least partially condensed overhead stream is fed into reflux accumulator 134. The vapor portion leaves accumulator 134 as vapor stream 136, which is compressed in compressor 140 and ultimately exits the system as residue or sales gas. A first portion 133 of the liquid exiting reflux accumulator 134 is directed back to de-ethanizer 130 as reflux through pump 137 and valve 139 via de-ethanizer reflux conduit 133, while a second portion is subcooled in exchanger 250, directed through valve 239, and recycled back directly into absorber 220, via recycle conduit 234, to be used as reflux.

The liquid in recycle conduit 234 is fed to an upper portion of absorber 220 to reduce the content of propane and heavier components in the overhead vapor stream. As the liquid in recycle conduit 234 enters absorber 220, a portion of the stream is vaporized and provides cooling in absorber 220 such that the overhead vapor is colder than any of the feeds to absorber 220 and is typically the coldest stream within the process. As a result, the overhead vapor portion recovered from absorber 220 as cooled vapor stream 224 is directed through heat exchangers 250 and 112 to provide subcooling for the absorber reflux liquid of stream in conduit 234 and to provide the initial cooling of the portion of feed stream 110 being conducted through conduit 111. After exiting heat exchanger 112, vapor stream 224 may be compressed as required and combined with compressed vapor stream 136 prior to exiting the system as residue gas or as a natural gas product.

During periods of low NGL prices, when the capital investment and operating expenses associated with cryogenic operation may not economically justify high recovery levels, it is desirable to adjust the operating conditions within the system to only recover sufficient NGL to meet residue gas specifications. Embodiments of the inventive, enhanced LTS process are directed to a low cost alternative, which meets residue gas specification requirements, while operating at substantially lower costs than conventional LTS or cryogenic processes.

Figure 3:
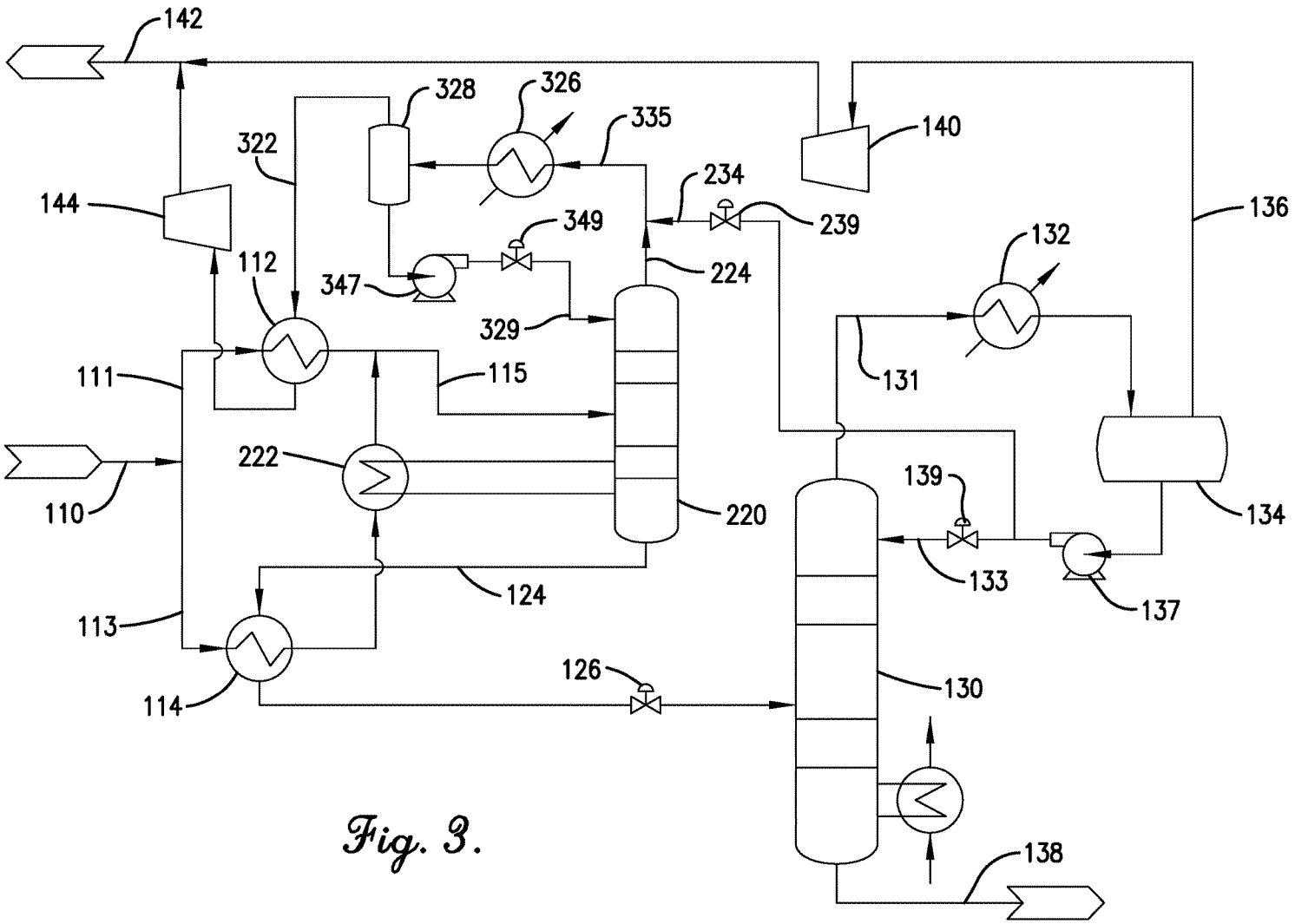
FIG. 3 is a process flow diagram showing an enhanced low temperature separation process in accordance with embodiments the present invention.

One embodiment of the enhanced LTS process in accordance with the present invention is shown in FIG. 3, with like components being labeled with the same reference numerals used in FIGS. 1 and 2. Like the conventional LTS process, feed gas is fed into the system via feed stream 110 and split, with one portion of the stream being directed via first conduit 111 through heat exchanger 112 and the other portion of the stream being directed via second conduit 113 through heat exchanger 114. The split portions are then recombined into a third conduit 115 as a cooled feed stream. Unlike either the conventional LTS or prior art cryogenic process of FIG. 2, however, the enhanced LTS process of the present invention does not have final cooling (e.g., chiller, cold separator, and/or feed stream expansion) upstream of absorber 220. Advantageously, the enhanced LTS process uses absorber 220 instead of cold separator 120 to provide initial separation, thereby eliminating the need for refrigerant chiller 116 and/or significant expansion to provide the required cooling to condense the heavier hydrocarbons at this stage in the process. With final cooling located downstream of absorber 220 (i.e., chiller 326), the combined feed stream fed via conduit 115 to absorber 220 operates at a warmer temperature than prior art processes, and the resulting content of lighter hydrocarbon components in the absorber bottoms is significantly reduced. In certain embodiments, the feed stream fed via conduit 115 to absorber 220 operates at a temperature of greater than about −20° F., preferably greater than about −10° F., more preferably greater than about 0° F., and most preferably greater than about 5° F.

The portion of feed stream 110 being conducted via conduit 113 can be used to provide some or all of the thermal energy necessary for reboiler 222 of absorber 220. Heat exchange occurring in reboiler 222 provides further cooling to the portion of feed stream in conduit 113, as well as heating to the bottoms portion of absorber 220. Heating the bottoms portion of absorber 220 reduces the content of lighter hydrocarbons contained in the stream and reduces the stream 124 volume, reducing the size of equipment located downstream Absorber overhead stream 224 exits absorber 220 as a vapor stream comprising predominantly methane and ethane, although some amount of propane and heavier hydrocarbons are also present. A condensed liquid exits absorber 220 as liquid bottoms stream 124. As a result of the warmer operating temperature of absorber 220 as compared to prior art processes, liquid bottoms stream 124 is significantly warmer than in prior art processes. In certain embodiments, the temperature of liquid bottoms stream 124 is greater than about 35° F., preferably greater than about 45° F., more preferably greater than about 55° F., and most preferably greater than about 60° F. The absorber and related streams operate at relatively higher pressures than prior art cryogenic processes. For example, in certain embodiments the absorbers operates at greater than about 400 pisa, preferably greater than about 600 psia, more preferably greater than about 700 psia, and most preferably greater than about 800 psia. Despite the warmer temperatures, liquid bottoms stream 124 may still be passed through heat exchanger 114 and used to cool a portion of feed stream 110 being conducted via conduit 113.

After exiting heat exchanger 114, liquid bottoms stream 124 is flashed through expansion device 126 and fed into de-ethanizer 130. Similar to the conventional process, in certain embodiments, expansion device 126 is located downstream of heat exchanger 114 (as shown in FIG. 3), but in certain other embodiments, expansion device 126 is located upstream of heat exchanger 114. The location of expansion device 126 will depend on desired process conditions for a particular application. For example, locating expansion device 126 upstream of heat exchanger 114 provides a colder liquid and allows for a smaller heat exchanger. However, the colder temperature may be a concern if it is near the limits of the pretreatment system, and a two-phase feed stream 124 may complicate the design of heat exchanger 114.

De-ethanizer 130 operates similarly in the enhanced LTS process as in the conventional and prior art cryogenic process insofar as ethane is rejected from the product stream. However, in the enhanced LTS process of the present invention, a portion of the condensed liquid exiting reflux accumulator 134 is recycled back and combined with overhead vapor stream 224, rather than directly to absorber 220. De-ethanizer overhead 131 is at least partially condensed in condenser 132, and the at least partially condensed overhead stream is fed into reflux accumulator 134. In some embodiments, however, de-ethanizer overhead 131 is entirely condensed in condenser 132. In embodiments where the overhead is partially condensed, the vapor portion leaves accumulator 134 as vapor stream 136, which is compressed in compressor 140 and ultimately exits the system as residue or sales gas. As a result of the warmer absorber feed and incorporation of an absorber reboiler, a greater amount of ethane and lighter compounds are removed from the liquid stream before being fed to de-ethanizer 130, and thus the flow of vapor stream 136 is significantly less than the conventional LTS or cryogenic processes. The significantly lower flow of vapor stream 136 provides a lower amount of vapor material flowing through compressor 140 compared to prior art processes, which decreases the amount of power (and cost) required to operate compressor 140. In certain embodiments in accordance with the present invention, a first portion of the liquid exiting reflux accumulator 134 is directed back to de-ethanizer 130 as reflux via de-ethanizer reflux conduit 133, while a second portion is recycled back and combined with vapor stream 224 to supplement the reflux of absorber 220 via recycle conduit 234.

The liquid in recycle conduit 234 is combined with absorber overhead vapor stream 224 to form two-phase recycle stream 335. Increased separation in absorber 220 is achieved by further condensing a portion of recycle stream 335 in chiller 326 to be used as reflux for absorber 220. In another embodiment of the present invention, the liquid in recycle conduit 234 may be combined with absorber overhead vapor stream 224 downstream of chiller 326. Advantageously, the required refrigerant compressor costs associated with the cooling in chiller 326 is lower than in chiller 116 (of the conventional LTS process), as there is a smaller temperature difference and less mass flow needed to cool in chiller 326 than in chiller 116. After exiting chiller 326, recycle stream 335 is directed into reflux accumulator 328, where the condensed liquid portion of recycle stream 335 is separated from the vapor portion. The vapor portion exits reflux accumulator 328 as cooled vapor stream 122 and is directed through heat exchanger 112 to provide cooling for the portion of feed stream 110 being conducted through conduit 111. After exiting heat exchanger 112, vapor stream 322 is combined with compressed vapor stream 136 and exits the system as residue gas or as a natural gas product.

The condensed liquid portion of recycle stream 335 exits reflux accumulator 328 as reflux stream 329 and is directed back into absorber 220. With final cooling of chiller 326 located downstream of absorber 220, stream 115 is fed to absorber 220 at much warmer temperatures and absorber 220 operates at much warmer temperatures than prior art processes. This causes a greater amount of both lighter components (e.g., ethane, methane) and heavier components (e.g., propane, butane) to be ejected in overhead vapor stream 224. The greater amount of heavier components in overhead vapor stream 224 causes the volume of reflux stream 329 to be much greater than absorber reflux streams of prior art cryogenic processes, which results in improved recovery of the butane and heavier components.

The enhanced LTS process in accordance with the present invention may be used in an LTS plant and advantageously provides increased selectivity in recovery of valuable NGL products (i.e., butane and heavier hydrocarbons) while reducing operating costs. The process is capable of producing an NGL liquid product stream comprising at least about 90 mol %, preferably at least about 95 mol %, and more preferably at least about 98 mol % propane and heavier hydrocarbons. The residue gas produced by the process comprises at least about 80 mol %, preferably at least about 90 mol %, and more preferably at least about 95 mol % ethane and lighter hydrocarbons. The enhanced LTS process reduces operating costs by using an absorber rather than a condenser/cold separator combination to achieve adequate initial separation of the lighter natural gas products from the heavier NGL products. Thus, the enhanced LTS process requires less external cooling of the feed stream and therefore less refrigerant compression costs. Use of the absorber and reflux recycling in the enhanced LTS process also results in a decrease of natural gas products requiring separation by de-ethanizer 130, and ultimately a significantly decreased molar flow rate of vapor stream 136 being directed through compressor 140. As less compression is required by compressor 140, there are reduced operating costs associated with this relatively high-cost process step.

EXAMPLES

The following examples set forth LTS process simulations prepared using Aspen HYSYS software by AspenTech. These examples provide more detail regarding specific stream and operating conditions of the conventional LTS, prior art cryogenic, and enhanced LTS processes generally described above. It is to be understood, however, that these examples are provided by way of illustration and nothing therein should be taken as a limitation upon the overall scope of the invention.

Example 1

Conventional LTS Process

In this example, there is provided a process simulation of a conventional LTS process such as the process shown in FIG. 1 and operated to achieve sufficient NGL recovery to meet a pipeline-quality residue gas higher heating value (HHV) of 1,140 Btu/scf. A pre-treated, dehydrated natural gas stream was fed into the system. The feed stream enters the system as a vapor at 99.1° F. and 890.7 psia, having a mass flow rate of about 478,100 lb/hr and the following approximate composition: 0.25% nitrogen, 2.17% carbon dioxide, 74.48% methane, 13.36% ethane, 5.81% propane, 2.74% butane, and 1.19% pentane and heavier hydrocarbons. Based on these feed conditions, the conventional process results in:

1) a residue/sales gas stream comprising about 80.2% methane, about 14.1% ethane, and about 3.1% propane and heavier hydrocarbons;
2) an NGL product stream having a mass flow of about 82,810 lb/hr and component molar percent recovery of approximately 1.8% ethane, 56.8% propane, 87.0% isobutane, and 90.2% normal butane; and
3) total compressor operating power of 12,620 hp.

Details regarding the stream conditions and equipment operating conditions resulting from a process simulation using the conventional LTS process are provided below:

| Stream | 110 | 111 | 111 (post-hx) | 113 |
|---|---|---|---|---|
| Vapor Fraction | 1.0000 | 1.0000 | 0.8127 | 1.0000 |
| Temperature (° F.) | 99.1 | 99.1 | −1.2 | 99.1 |
| Pressure (psia) | 890.7 | 890.7 | 880.7 | 890.7 |
| Molar Flow (lbmole/hr) | 21,679 | 11,490 | 11,490 | 10,189 |
| Mass Flow (lb/hr) | 478,086 | 253,386 | 253,386 | 224,701 |
| Heat Flow (Btu/hr) | −8.236E+08 | −4.365E+08 | −4.592E+08 | −3.871E+08 |
| Molecular Weight | 22.05 | 22.05 | 22.05 | 22.05 |
| Mass Density (lb/ft$^3$) | 4.120 | 4.120 | 6.740 | 4.120 |
| Heat Capacity (Btu/lb-° F.) | 0.6282 | 0.6282 | 0.7714 | 0.6282 |
| Cp/Cv | 1.568 | 1.568 | 1.725 | 1.568 |
| Mole Frac (Nitrogen) | 0.0025 | 0.0025 | 0.0025 | 0.0025 |
| Mole Frac ($CO_2$) | 0.0217 | 0.0217 | 0.0217 | 0.0217 |
| Mole Frac ($H_2S$) | 0.0000 | 0.0000 | 0.0000 | 0.0000 |
| Mole Frac (Methane) | 0.7448 | 0.7448 | 0.7448 | 0.7448 |
| Mole Frac (Ethane) | 0.1336 | 0.1336 | 0.1336 | 0.1336 |
| Mole Frac (Propane) | 0.0581 | 0.0581 | 0.0581 | 0.0581 |
| Mole Frac (i-Butane) | 0.0086 | 0.0086 | 0.0086 | 0.0086 |
| Mole Frac (n-Butane) | 0.0188 | 0.0188 | 0.0188 | 0.0188 |

-continued

| Stream | 110 | 111 | 111 (post-hx) | 113 |
|---|---|---|---|---|
| Mole Frac (i-Pentane) | 0.0046 | 0.0046 | 0.0046 | 0.0046 |
| Mole Frac (n-Pentane) | 0.0044 | 0.0044 | 0.0044 | 0.0044 |
| Mole Frac (C6+) | 0.0029 | 0.0029 | 0.0029 | 0.0029 |

| Stream | 113 (post-hx) | 115 | 118 | 124 |
|---|---|---|---|---|
| Vapor Fraction | 0.7326 | 0.7772 | 0.6681 | 0.0000 |
| Temperature (° F.) | −18.5 | −9.5 | −30.0 | −30 |
| Pressure (psia) | 880.7 | 880.7 | 870.7 | 870.7 |
| Molar Flow (lbmole/hr) | 10,189 | 21,679 | 21,679 | 7,194 |
| Mass Flow (lb/hr) | 224,701 | 478,086 | 478,086 | 207,327 |
| Heat Flow (Btu/hr) | −4.117E+08 | −8.710E+08 | −8.824E+08 | −3.379E+08 |
| Molecular Weight | 22.05 | 22.05 | 22.05 | 28.82 |
| Mass Density (lb/ft$^3$) | 7.782 | 7.192 | 8.568 | 26.316 |
| Heat Capacity (Btu/lb-° F.) | 0.8196 | 0.7928 | 0.8508 | 0.7425 |
| Cp/Cv | 1.728 | 1.727 | 1.712 | 1.102 |
| Mole Frac (Nitrogen) | 0.0025 | 0.0025 | 0.0025 | 0.0008 |
| Mole Frac ($CO_2$) | 0.0217 | 0.0217 | 0.0217 | 0.0255 |
| Mole Frac ($H_2S$) | 0.0000 | 0.0000 | 0.0000 | 0.0000 |
| Mole Frac (Methane) | 0.7448 | 0.7448 | 0.7448 | 0.5105 |
| Mole Frac (Ethane) | 0.1336 | 0.1336 | 0.1336 | 0.2201 |
| Mole Frac (Propane) | 0.0581 | 0.0581 | 0.0581 | 0.1349 |
| Mole Frac (i-Butane) | 0.0086 | 0.0086 | 0.0086 | 0.0225 |
| Mole Frac (n-Butane) | 0.0188 | 0.0188 | 0.0188 | 0.0511 |
| Mole Frac (i-Pentane) | 0.0046 | 0.0046 | 0.0046 | 0.0131 |
| Mole Frac (n-Pentane) | 0.0044 | 0.0044 | 0.0044 | 0.0129 |
| Mole Frac (C6+) | 0.0029 | 0.0029 | 0.0029 | 0.0085 |

| Stream | 124 (post-hx) | 124 (expansion) | 136 | Residue/ sales gas | 138 (NGL) |
|---|---|---|---|---|---|
| Vapor Fraction | 0.6948 | 0.7713 | 1.0000 | 1.0000 | 0.0000 |
| Temperature (° F.) | 79.5 | 45.0 | −16.0 | 119.3 | 212.8 |
| Pressure (psia) | 860.7 | 400.0 | 390.0 | 1162.3 | 400.0 |
| Molar Flow (lbmole/hr) | 7,194 | 7,194 | 5,650 | 20,135 | 1,544 |
| Mass Flow (lb/hr) | 207,327 | 207,327 | 124,519 | 395,278 | 82,808 |
| Heat Flow (Btu/hr) | −3.133E+08 | −3.133E+08 | −2.247E+08 | −7.391E+08 | −8.436E+07 |
| Molecular Weight | 28.82 | 28.82 | 22.04 | 19.63 | 53.62 |
| Mass Density (lb/ft$^3$) | 7.692 | 3.182 | 2.276 | 4.424 | 26.382 |
| Heat Capacity (Btu/lb-° F.) | 0.7052 | 0.5541 | 0.5474 | 0.6435 | 0.9100 |
| Cp/Cv | 1.410 | 1.237 | 1.592 | 1.563 | 1.042 |
| Mole Frac (Nitrogen) | 0.0008 | 0.0008 | 0.0010 | 0.0027 | 0.0000 |
| Mole Frac ($CO_2$) | 0.0255 | 0.0255 | 0.0325 | 0.0234 | 0.0000 |
| Mole Frac ($H_2S$) | 0.0000 | 0.0000 | 0.0000 | 0.0000 | 0.0000 |
| Mole Frac (Methane) | 0.5105 | 0.5105 | 0.6501 | 0.8019 | 0.0000 |
| Mole Frac (Ethane) | 0.2201 | 0.2201 | 0.2712 | 0.1413 | 0.0333 |
| Mole Frac (Propane) | 0.1349 | 0.1349 | 0.0452 | 0.0270 | 0.4631 |
| Mole Frac (i-Butane) | 0.0225 | 0.0225 | 0.0001 | 0.0012 | 0.1047 |
| Mole Frac (n-Butane) | 0.0511 | 0.0511 | 0.0000 | 0.0020 | 0.2379 |
| Mole Frac (i-Pentane) | 0.0131 | 0.0131 | 0.0000 | 0.0003 | 0.0613 |
| Mole Frac (n-Pentane) | 0.0129 | 0.0129 | 0.0000 | 0.0002 | 0.0599 |
| Mole Frac (C6+) | 0.0085 | 0.0085 | 0.0000 | 0.0000 | 0.0398 |

| 116 & 132 (Chiller refrigerant compressors) | 140 (De-ethanizer compressor) | Residue/Sales gas compressor | Total compressor power |
|---|---|---|---|
| 7790 hp | 2550 hp | 2280 hp | 12620 hp |

Example 2

Prior Art Cryogenic Process

In this example, there is provided a process simulation of a prior art cryogenic process such as the process shown in FIG. 2. However, for comparative purposes, the cryogenic process has been modified from the '245 publication to achieve sufficient NGL recovery to meet the same pipeline-quality residue gas higher heating value (HHV) of 1,140 Btu/scf. A pre-treated, dehydrated natural gas stream was fed into the system. The feed stream enters the system as a vapor at 99.1° F. and 890.7 psia, having a mass flow rate of about 478,100 lb/hr and the following approximate composition: 0.25% nitrogen, 2.17% carbon dioxide, 74.48% methane, 13.36% ethane, 5.81% propane, 2.74% butane, and 1.19% pentane and heavier hydrocarbons. Based on these feed conditions, the cryogenic process results in:

1) a residue/sales gas stream comprising about 80.1% methane, about 14.1% ethane, and about 3.1% propane and heavier hydrocarbons;

2) an NGL product stream having a mass flow of about 82,470 lb/hr and component molar percent recovery of approximately 1.7% ethane, 53.6% propane, 88.2% isobutane, and 93.4% normal butane; and 3) total compressor operating power of 10,256 hp.

Details regarding the stream conditions and equipment operating conditions resulting from a process simulation using the cryogenic process are provided below:

| Stream | 110 | 111 | 111(post-hx) | 113 |
|---|---|---|---|---|
| Vapor Fraction | 1.0000 | 1.0000 | 0.8031 | 1.0000 |
| Temperature (° F.) | 99.1 | 99.1 | −3.6 | 99.1 |
| Pressure (psia) | 890.7 | 890.7 | 880.7 | 890.7 |
| Molar Flow (lbmole/hr) | 21,679 | 13,658 | 13,658 | 8,021 |
| Mass Flow (lb/hr) | 478,086 | 301,194 | 301,194 | 176,892 |
| Heat Flow (Btu/hr) | −8.236E+08 | −5.189E+08 | −5.467E+08 | −3.047E+08 |
| Molecular Weight | 22.05 | 22.05 | 22.05 | 22.05 |
| Mass Density (lb/ft$^3$) | 4.120 | 4.120 | 6.860 | 4.120 |
| Heat Capacity (Btu/lb-° F.) | 0.6282 | 0.6282 | 0.7772 | 0.6282 |
| Cp/Cv | 1.568 | 1.568 | 1.726 | 1.568 |
| Mole Frac (Nitrogen) | 0.0025 | 0.0025 | 0.0025 | 0.0025 |
| Mole Frac ($CO_2$) | 0.0217 | 0.0217 | 0.0217 | 0.0217 |
| Mole Frac ($H_2S$) | 0.0000 | 0.0000 | 0.0000 | 0.0000 |
| Mole Frac (Methane) | 0.7448 | 0.7448 | 0.7448 | 0.7448 |
| Mole Frac (Ethane) | 0.1336 | 0.1336 | 0.1336 | 0.1336 |
| Mole Frac (Propane) | 0.0581 | 0.0581 | 0.0581 | 0.0581 |
| Mole Frac (i-Butane) | 0.0086 | 0.0086 | 0.0086 | 0.0086 |
| Mole Frac (n-Butane) | 0.0188 | 0.0188 | 0.0188 | 0.0188 |
| Mole Frac (i-Pentane) | 0.0046 | 0.0046 | 0.0046 | 0.0046 |
| Mole Frac (n-Pentane) | 0.0044 | 0.0044 | 0.0044 | 0.0044 |
| Mole Frac (C6+) | 0.0029 | 0.0029 | 0.0029 | 0.0029 |

| Stream | 113 (post-hx) | 115 | 118 | 124 |
|---|---|---|---|---|
| Vapor Fraction | 0.8214 | 0.8100 | 0.7211 | 0.0000 |
| Temperature (° F.) | 1.0 | −1.9 | −21.0 | 32.9 |
| Pressure (psia) | 880.7 | 880.7 | 875.7 | 870.0 |
| Molar Flow (lbmole/hr) | 8,021 | 21,679 | 21,679 | 4,676 |
| Mass Flow (lb/hr) | 176,892 | 478,086 | 478,086 | 161,088 |
| Heat Flow (Btu/hr) | −3.202E+08 | −8.668E+08 | −8.772E+08 | −2.324E+08 |
| Molecular Weight | 22.05 | 22.05 | 22.05 | 34.45 |
| Mass Density (lb/ft$^3$) | 6.631 | 6.774 | 7.887 | 26.930 |
| Heat Capacity (Btu/lb-° F.) | 0.7662 | 0.7730 | 0.8233 | 0.7308 |
| Cp/Cv | 1.724 | 1.725 | 1.721 | 1.086 |
| Mole Frac (Nitrogen) | 0.0025 | 0.0025 | 0.0025 | 0.0001 |
| Mole Frac ($CO_2$) | 0.0217 | 0.0217 | 0.0217 | 0.0260 |
| Mole Frac ($H_2S$) | 0.0000 | 0.0000 | 0.0000 | 0.0000 |
| Mole Frac (Methane) | 0.7448 | 0.7448 | 0.7448 | 0.3273 |
| Mole Frac (Ethane) | 0.1336 | 0.1336 | 0.1336 | 0.2756 |
| Mole Frac (Propane) | 0.0581 | 0.0581 | 0.0581 | 0.1992 |
| Mole Frac (i-Butane) | 0.0086 | 0.0086 | 0.0086 | 0.0354 |
| Mole Frac (n-Butane) | 0.0188 | 0.0188 | 0.0188 | 0.0814 |
| Mole Frac (i-Pentane) | 0.0046 | 0.0046 | 0.0046 | 0.0211 |
| Mole Frac (n-Pentane) | 0.0044 | 0.0044 | 0.0044 | 0.0205 |
| Mole Frac (C6+) | 0.0029 | 0.0029 | 0.0029 | 0.0133 |

| Stream | 124 (post-hx) | 124 (expansion) | 136 | Residue/ sales gas | 138 (NGL) |
|---|---|---|---|---|---|
| Vapor Fraction | 0.2431 | 0.4597 | 1.0000 | 1.0000 | 0.0000 |
| Temperature (° F.) | 77.0 | 47.9 | −16.0 | 119.7 | 227.5 |
| Pressure (psia) | 860.0 | 440.0 | 430.0 | 1162.3 | 440.0 |
| Molar Flow (lbmole/hr) | 4,676 | 4,676 | 2,160 | 20,154 | 1,525 |
| Mass Flow (lb/hr) | 161,088 | 161,088 | 48,338 | 395,615 | 82,471 |
| Heat Flow (Btu/hr) | −2.255E+08 | −2.255E+08 | −8.872E+07 | −7.395E+08 | −8.283E+07 |
| Molecular Weight | 34.45 | 34.45 | 22.38 | 19.63 | 54.07 |
| Mass Density (lb/ft$^3$) | 15.617 | 6.463 | 2.649 | 4.417 | 25.323 |
| Heat Capacity (Btu/lb-° F.) | 0.7563 | 0.6031 | 0.5696 | 0.6432 | 0.9834 |
| Cp/Cv | 1.248 | 1.125 | 1.674 | 1.562 | 1.039 |
| Mole Frac (Nitrogen) | 0.0001 | 0.0001 | 0.0003 | 0.0027 | 0.0000 |
| Mole Frac ($CO_2$) | 0.0260 | 0.0260 | 0.0415 | 0.0234 | 0.0000 |
| Mole Frac ($H_2S$) | 0.0000 | 0.0000 | 0.0000 | 0.0000 | 0.0000 |
| Mole Frac (Methane) | 0.3273 | 0.3273 | 0.6184 | 0.8012 | 0.0000 |
| Mole Frac (Ethane) | 0.2756 | 0.2756 | 0.3107 | 0.1413 | 0.0319 |
| Mole Frac (Propane) | 0.1992 | 0.1992 | 0.0290 | 0.0290 | 0.4427 |
| Mole Frac (i-Butane) | 0.0354 | 0.0354 | 0.0001 | 0.0011 | 0.1074 |
| Mole Frac (n-Butane) | 0.0814 | 0.0814 | 0.0000 | 0.0013 | 0.2495 |

-continued

| | | | | | |
|---|---|---|---|---|---|
| Mole Frac (i-Pentane) | 0.0211 | 0.0211 | 0.0000 | 0.0001 | 0.0647 |
| Mole Frac (n-Pentane) | 0.0205 | 0.0205 | 0.0000 | 0.0000 | 0.0629 |
| Mole Frac (C6+) | 0.0133 | 0.0133 | 0.0000 | 0.0000 | 0.0409 |

| 116 & 132 (Chiller refrigerant compressors) | 140 (De-ethanizer compressor) | Residue/Sales gas compressor | Total Compressor Power |
|---|---|---|---|
| 6504 hp | 847 hp | 2905 hp | 10256 hp |

Example 3

Enhanced LTS Process

In this example, there is provided a process simulation of an enhanced LTS process in accordance with the present invention, such as the process shown in FIG. 3 and operated to achieve sufficient NGL recovery to meet the same pipeline-quality residue gas higher heating value (HHV) of 1,140 Btu/scf. A pre-treated, dehydrated natural gas stream was fed into the system. Like the simulations of the conventional LTS and prior art cryogenic processes, the feed stream enters as a vapor at 99.1° F. and 890.7 psia, having a mass flow rate of about 478,100 lb/hr and the following approximate composition: 0.25% nitrogen, 2.17% carbon dioxide, 74.48% methane, 13.36% ethane, 5.81% propane, 2.74% butane, and 1.19% pentane and heavier hydrocarbons. Based on these feed conditions, the enhanced process results in:

1) a residue/sales gas stream comprising about 80.1% methane, about 14.1% ethane, and about 3.2% propane and heavier hydrocarbons;
2) an NGL product stream having a mass flow of about 82,570 lb/hr and component molar percent recovery of approximately 1.6% ethane, 50.9% propane, 92.0% isobutane, and 98.3% normal butane; and
3) total compressor operating power of 9,892 hp Therefore, the enhanced LTS process provides the highest butane recovery levels while requiring 22% less total compression power than the conventional LTS process and 3.5% less than the prior art cryogenic process. Further, the feed flow to the de-ethanizer in stream 124 is 33% lower than the conventional LTS process and 15% lower than the prior art cryogenic process, allowing for smaller piping and equipment sizes.

Details regarding the stream conditions and equipment operating conditions resulting from a process simulation using the enhanced LTS process are provided below:

| Stream | 110 | 111 | 111(post-hx) | 113 |
|---|---|---|---|---|
| Vapor Fraction | 1.0000 | 1.0000 | 0.8149 | 1.0000 |
| Temperature (° F.) | 99.1 | 99.1 | −0.7 | 99.1 |
| Pressure (psia) | 890.7 | 890.7 | 880.7 | 890.7 |
| Molar Flow (lbmole/hr) | 21,679 | 15,175 | 15,175 | 6,504 |
| Mass Flow (lb/hr) | 478,086 | 334,660 | 334,660 | 143,426 |
| Heat Flow (Btu/hr) | −8.236E+08 | −5.765E+08 | −6.063E+08 | −2.471E+08 |
| Molecular Weight | 22.05 | 22.05 | 22.05 | 22.05 |
| Mass Density (lb/ft$^3$) | 4.120 | 4.120 | 6.712 | 4.120 |
| Heat Capacity (Btu/lb-° F.) | 0.6282 | 0.6282 | 0.7701 | 0.6282 |
| Cp/Cv | 1.568 | 1.568 | 1.725 | 1.568 |
| Mole Frac (Nitrogen) | 0.0025 | 0.0025 | 0.0025 | 0.0025 |
| Mole Frac ($CO_2$) | 0.0217 | 0.0217 | 0.0217 | 0.0217 |
| Mole Frac ($H_2S$) | 0.0000 | 0.0000 | 0.0000 | 0.0000 |
| Mole Frac (Methane) | 0.7448 | 0.7448 | 0.7448 | 0.7448 |
| Mole Frac (Ethane) | 0.1336 | 0.1336 | 0.1336 | 0.1336 |
| Mole Frac (Propane) | 0.0581 | 0.0581 | 0.0581 | 0.0581 |
| Mole Frac (i-Butane) | 0.0086 | 0.0086 | 0.0086 | 0.0086 |
| Mole Frac (n-Butane) | 0.0188 | 0.0188 | 0.0188 | 0.0188 |
| Mole Frac (i-Pentane) | 0.0046 | 0.0046 | 0.0046 | 0.0046 |
| Mole Frac (n-Pentane) | 0.0044 | 0.0044 | 0.0044 | 0.0044 |
| Mole Frac (C6+) | 0.0029 | 0.0029 | 0.0029 | 0.0029 |

| Stream | 113 (post-hx) | 115 | 124 | 124 (post-hx) |
|---|---|---|---|---|
| Vapor Fraction | 0.9023 | 0.8437 | 0.0000 | 0.0699 |
| Temperature (° F.) | 25.8 | 7.0 | 62.7 | 76.7 |
| Pressure (psia) | 880.7 | 880.7 | 875.0 | 865.0 |
| Molar Flow (lbmole/hr) | 6,504 | 21,679 | 3,693 | 3,693 |
| Mass Flow (lb/hr) | 143,426 | 478,086 | 137,502 | 137,502 |
| Heat Flow (Btu/hr) | −2.559E+08 | −8.622E+08 | −1.862E+08 | −1.845E+08 |
| Molecular Weight | 22.05 | 22.05 | 37.23 | 37.23 |
| Mass Density (lb/ft$^3$) | 5.649 | 6.354 | 26.814 | 22.354 |
| Heat Capacity (Btu/lb-° F.) | 0.7170 | 0.7527 | 0.7347 | 0.7456 |
| Cp/Cv | 1.714 | 1.722 | 1.078 | 1.328 |
| Mole Frac (Nitrogen) | 0.0025 | 0.0025 | 0.0002 | 0.0002 |
| Mole Frac ($CO_2$) | 0.0217 | 0.0217 | 0.0206 | 0.0206 |
| Mole Frac ($H_2S$) | 0.0000 | 0.0000 | 0.0000 | 0.0000 |

-continued

| Stream | 113 (post-hx) | 115 | 124 | 124 (post-hx) |
|---|---|---|---|---|
| Mole Frac (Methane) | 0.7448 | 0.7448 | 0.2788 | 0.2788 |
| Mole Frac (Ethane) | 0.1336 | 0.1336 | 0.2481 | 0.2481 |
| Mole Frac (Propane) | 0.0581 | 0.0581 | 0.2259 | 0.2259 |
| Mole Frac (i-Butane) | 0.0086 | 0.0086 | 0.0473 | 0.0473 |
| Mole Frac (n-Butane) | 0.0188 | 0.0188 | 0.1090 | 0.1090 |
| Mole Frac (i-Pentane) | 0.0046 | 0.0046 | 0.0270 | 0.0270 |
| Mole Frac (n-Pentane) | 0.0044 | 0.0044 | 0.0261 | 0.0261 |
| Mole Frac (C6+) | 0.0029 | 0.0029 | 0.0169 | 0.0169 |

| Stream | 124 (expansion) | 136 | 224 | 234 |
|---|---|---|---|---|
| Vapor Fraction | 0.3535 | 1.0000 | 1.0000 | 0.0000 |
| Temperature (° F.) | 47.0 | −25.0 | −8.0 | −18.4 |
| Pressure (psia) | 400.0 | 390.0 | 870.0 | 870.0 |
| Molar Flow (lbmole/hr) | 3,693 | 1,351 | 21,448 | 825 |
| Mass Flow (lb/hr) | 137,502 | 29,623 | 430,311 | 25,311 |
| Heat Flow (Btu/hr) | −1.845E+08 | −5.470E+07 | −8.231E+08 | −3.936E+07 |
| Molecular Weight | 37.23 | 21.92 | 20.06 | 30.68 |
| Mass Density (lb/ft$^3$) | 7.669 | 2.343 | 5.731 | 28.776 |
| Heat Capacity (Btu/lb-° F.) | 0.5987 | 0.5530 | 0.8880 | 0.6830 |
| Cp/Cv | 1.084 | 1.629 | 2.384 | 1.847 |
| Mole Frac (Nitrogen) | 0.0002 | 0.0005 | 0.0027 | 0.0000 |
| Mole Frac ($CO_2$) | 0.0206 | 0.0380 | 0.0228 | 0.0301 |
| Mole Frac ($H_2S$) | 0.0000 | 0.0000 | 0.0000 | 0.0000 |
| Mole Frac (Methane) | 0.2788 | 0.6439 | 0.7876 | 0.1935 |
| Mole Frac (Ethane) | 0.2481 | 0.2925 | 0.1378 | 0.5758 |
| Mole Frac (Propane) | 0.2259 | 0.0248 | 0.0465 | 0.1939 |
| Mole Frac (i-Butane) | 0.0473 | 0.0002 | 0.0018 | 0.0042 |
| Mole Frac (n-Butane) | 0.1090 | 0.0001 | 0.0010 | 0.0024 |
| Mole Frac (i-Pentane) | 0.0270 | 0.0000 | 0.0000 | 0.0000 |
| Mole Frac (n-Pentane) | 0.0261 | 0.0000 | 0.0000 | 0.0000 |
| Mole Frac (C6+) | 0.0169 | 0.0000 | 0.0000 | 0.0000 |

| Stream | 335 | 329 | 322 | Residue/ Sales gas | 138 (NGL) |
|---|---|---|---|---|---|
| Vapor Fraction | 0.9567 | 0.0000 | 1.0000 | 1.0000 | 0.0000 |
| Temperature (° F.) | −8.5 | −24.7 | −25.0 | 119.9 | 218.8 |
| Pressure (psia) | 870.0 | 875.0 | 860.0 | 1162.3 | 400.0 |
| Molar Flow (lbmole/hr) | 22,273 | 3,463 | 18,811 | 20,162 | 1,517 |
| Mass Flow (lb/hr) | 455,623 | 89,728 | 365,895 | 395,518 | 82,567 |
| Heat Flow (Btu/hr) | −8.624E+08 | −1.541E+08 | −7.187E+08 | −7.394E+08 | −8.348E+07 |
| Molecular Weight | 20.46 | 25.91 | 19.45 | 19.62 | 54.43 |
| Mass Density (lb/ft$^3$) | 6.090 | 22.825 | 5.967 | 4.411 | 26.334 |
| Heat Capacity (Btu/lb-° F.) | 0.9031 | 0.9041 | 0.9847 | 0.6430 | 0.9150 |
| Cp/Cv | 2.300 | 1.093 | 2.647 | 1.561 | 1.042 |
| Mole Frac (Nitrogen) | 0.0026 | 0.0008 | 0.0029 | 0.0027 | 0.0000 |
| Mole Frac ($CO_2$) | 0.0230 | 0.0270 | 0.0223 | 0.0234 | 0.0000 |
| Mole Frac ($H_2S$) | 0.0000 | 0.0000 | 0.0000 | 0.0000 | 0.0000 |
| Mole Frac (Methane) | 0.7656 | 0.5130 | 0.8121 | 0.8008 | 0.0000 |
| Mole Frac (Ethane) | 0.1540 | 0.2817 | 0.1305 | 0.1413 | 0.0304 |
| Mole Frac (Propane) | 0.0519 | 0.1651 | 0.0311 | 0.0307 | 0.4225 |
| Mole Frac (i-Butane) | 0.0019 | 0.0077 | 0.0008 | 0.0007 | 0.1127 |
| Mole Frac (n-Butane) | 0.0010 | 0.0046 | 0.0004 | 0.0003 | 0.2641 |
| Mole Frac (i-Pentane) | 0.0000 | 0.0000 | 0.0000 | 0.0000 | 0.0657 |
| Mole Frac (n-Pentane) | 0.0000 | 0.0000 | 0.0000 | 0.0000 | 0.0635 |
| Mole Frac (C6+) | 0.0000 | 0.0000 | 0.0000 | 0.0000 | 0.0411 |

| 132 & 326 (Chiller refrigerant compressors) | 140 (De-ethanizer compressor) | Residue/Sales gas compressor | Total Compressor Power |
|---|---|---|---|
| 6266 hp | 591 hp | 3035 hp | 9892 hp |

I claim:

1. An enhanced low temperature process for separating light hydrocarbon components from heavy hydrocarbon components in a feed stream, said process comprising:

cooling said feed stream by directing said feed stream through at least one heat exchanger so as to condense at least a portion of said feed stream;

directing said partially condensed feed stream into an absorber and producing from the absorber an absorber overhead vapor stream and an absorber liquid bottoms stream;

flashing said absorber liquid bottoms stream into a de-ethanizer tower, thereby producing a de-ethanizer overhead vapor stream and a liquid product stream enriched in $C_3$+hydrocarbon compounds;

condensing at least a portion of said de-ethanizer overhead vapor stream to form a liquid reflux stream and using a first portion of the liquid reflux stream as reflux in the de-ethanizer tower;

combining said absorber overhead vapor stream with a second portion of the liquid reflux stream to produce a two-phase absorber recycle stream; and directing at least a portion of said absorber recycle stream to said absorber as liquid reflux.

2. The process of claim 1, wherein said feed stream is a dehydrated natural gas stream.

3. The process of claim 1, wherein said feed stream is split into two or more portions, wherein one of said two or more portions is cooled by the absorber liquid bottoms stream in a first heat exchanger of the at least one heat exchanger, and wherein another of said two or more portions is cooled by at least a portion of the absorber recycle stream.

4. The process of claim 1, wherein said absorber comprises an absorber reboiler, and wherein said one of said two or more portions is used to provide heat to said reboiler.

5. The process of claim 1, wherein said liquid product stream comprises at least 90 mol % of propane and heavier hydrocarbons.

6. The process of claim 1, said process configured to produce a residue gas product comprising at least 80 mol % of ethane and lighter hydrocarbons.

7. The process of claim 1, wherein said partially condensed feed stream is directed into said absorber at a temperature of greater than −20° F.

8. The process of claim 1, wherein said absorber bottoms liquid stream is produced at a temperature of greater than 35° F.

9. The process of claim 1, further comprising prior to said cooling, splitting said feed stream into a first portion and a second portion, wherein said cooling comprises cooling said first portion of said feed stream in a first heat exchanger of the at least one heat exchanger and cooling said second portion of said feed stream in a second heat exchanger of the at least one heat exchanger.

10. The process of claim 9, wherein said absorber comprises a reboiler, wherein said second portion of said feed stream provides at least a portion of the heating duty for said reboiler.

11. The process of claim 10, further comprising combining said first portion and said second portion to thereby produce said partially condensed feed stream.

12. The process of claim 11, further comprising prior to said flashing, passing said absorber liquid bottoms stream through said second heat exchanger to provide cooling to said second portion of said feed stream.

13. The process of claim 12, further comprising compressing an uncondensed portion of said de-ethanizer overhead vapor stream to form a residue vapor stream.

14. The process of claim 13, further comprising using a first portion of the liquid reflux stream as reflux in the de-ethanizer tower.

15. The process of claim 14, wherein said combining said absorber overhead vapor stream with said second portion of the liquid reflux stream occurs either:

(a) upstream of a chiller through which said two-phase absorber recycle stream is passed;

or (b) downstream of a chiller through which said absorber overhead vapor stream, and not said second portion of the liquid reflux stream, is passed.

16. The process of claim 15, further comprising separating said two phase absorber recycle stream to produce a cooled liquid recycle stream and a cooled vapor stream.

17. The process of claim 16, further comprising directing said cooled liquid recycle stream to said absorber as said liquid reflux.

18. The process of claim 17, further comprising passing said cooled vapor through said first heat exchanger to provide cooling to said first portion of said feed stream.

19. The process of claim 18, further comprising combining said cooled vapor with said residue vapor stream to produce a combined residue gas stream.

* * * * *